US009032935B2

(12) United States Patent
Ghoneim et al.

(10) Patent No.: US 9,032,935 B2
(45) Date of Patent: May 19, 2015

(54) METHOD AND APPARATUS TO MONITOR AN ELECTRIC MOTOR IN A RETURNLESS FUEL SYSTEMS

(75) Inventors: Youssef A. Ghoneim, Rochester, MI (US); Mark N. Howell, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 867 days.

(21) Appl. No.: 13/288,073

(22) Filed: Nov. 3, 2011

(65) Prior Publication Data

US 2013/0112173 A1 May 9, 2013

(51) Int. Cl.

| | |
|---|---|
| ***F02M 37/08*** | (2006.01) |
| ***F04B 49/06*** | (2006.01) |
| ***F04B 49/10*** | (2006.01) |
| ***F02M 37/00*** | (2006.01) |
| ***F02D 33/00*** | (2006.01) |
| *F02D 41/30* | (2006.01) |
| *F02M 63/02* | (2006.01) |

(52) U.S. Cl.

CPC ..... *F02M 37/08* (2013.01); *F04B 49/06* (2013.01); *F04B 49/103* (2013.01); *F04B 2203/0201* (2013.01); *F04B 2203/0209* (2013.01); *F04B 2205/03* (2013.01); *F02M 37/0058* (2013.01); *F02D 33/003* (2013.01); *F02M 63/0295* (2013.01); *F02M 63/028* (2013.01)

(58) Field of Classification Search

CPC .... F02M 37/08; F02D 41/30; F02D 41/3082; F02D 2200/0602; G06F 7/00

USPC ..... 123/497, 516; 417/45; 701/105, 29.1, 701/29.4

See application file for complete search history.

(56) References Cited

U.S. PATENT DOCUMENTS

| | | | | |
|---|---|---|---|---|
| 5,394,844 | A * | 3/1995 | Akimoto | 123/179.3 |
| 6,698,401 | B2 * | 3/2004 | Suzuki et al. | 123/516 |
| 8,473,147 | B2 * | 6/2013 | Ghoneim | 701/29.4 |
| 8,706,383 | B2 * | 4/2014 | Sauve et al. | 701/105 |

OTHER PUBLICATIONS

U.S. Appl. No. 13/069,457, filed Mar. 23, 2011, Ghoneim.

* cited by examiner

*Primary Examiner* — Hieu T Vo

(57) ABSTRACT

A method for monitoring the fuel pump includes estimating a pump speed and a nominal pump motor current in relation to a pump motor control signal and a fuel pressure. An armature resistance and a back-emf constant for the electric motor are determined corresponding to the estimated pump speed, a monitored pump motor current, and the pump motor control signal. A nominal armature resistance and a nominal back-emf constant for the electric motor are adjusted in relation to a pump motor temperature. Residuals are calculated based upon the adjusted nominal armature resistance, the adjusted nominal back-emf constant for the electric motor, the estimated armature resistance and the estimated back-emf constant for the electric motor. The residuals are compared with corresponding thresholds. A fault in the electric motor is detected based upon the comparisons of the residuals with the corresponding thresholds.

18 Claims, 3 Drawing Sheets

METHOD AND APPARATUS TO MONITOR AN ELECTRIC MOTOR IN A RETURNLESS FUEL SYSTEMS

TECHNICAL FIELD

This disclosure is related to fuel delivery systems.

BACKGROUND

The statements in this section merely provide background information related to the present disclosure. Accordingly, such statements are not intended to constitute an admission of prior art.

Fuel systems supply fuel to internal combustion engines. One known fuel system includes a fuel pump and electric motor that are submerged in a fuel tank. A fuel filter and a pressure regulator may be positioned on the intake and outlet sides of the fuel pump, respectively. Filtered fuel is delivered to a fuel rail for injection into the engine cylinders. One embodiment of a fuel system includes a returnless fuel system that is assembled into a fuel tank and is characterized by a single fuel line fluidly connected to a fuel rail. A returnless fuel system lacks a fuel return line from the fuel rail and is unable to circulate fuel between the fuel rail and fuel tank, thus eliminating fuel heating and weathering.

A fault in a returnless fuel system may result in replacement of the returnless fuel system during service. Information determined during on-board operation of the returnless fuel system may assist in determining a root cause of such a fault.

SUMMARY

An electric motor is configured to provide mechanical power to a fuel pump. A method for monitoring the fuel pump includes estimating a pump speed and a nominal pump motor current in relation to a pump motor control signal and a fuel pressure. An armature resistance and a back-emf constant for the electric motor are determined corresponding to the estimated pump speed, a monitored pump motor current, and the pump motor control signal. A nominal armature resistance and a nominal back-emf constant for the electric motor are adjusted in relation to a pump motor temperature. A plurality of residuals are calculated based upon the adjusted nominal armature resistance, the adjusted nominal back-emf constant for the electric motor, the estimated armature resistance and the estimated back-emf constant for the electric motor. The residuals are compared with corresponding thresholds. A fault in the electric motor is detected based upon the comparisons of the residuals with the corresponding thresholds.

BRIEF DESCRIPTION OF THE DRAWINGS

One or more embodiments will now be described, by way of example, with reference to the accompanying drawings, in which.

DETAILED DESCRIPTION

Figure 1:
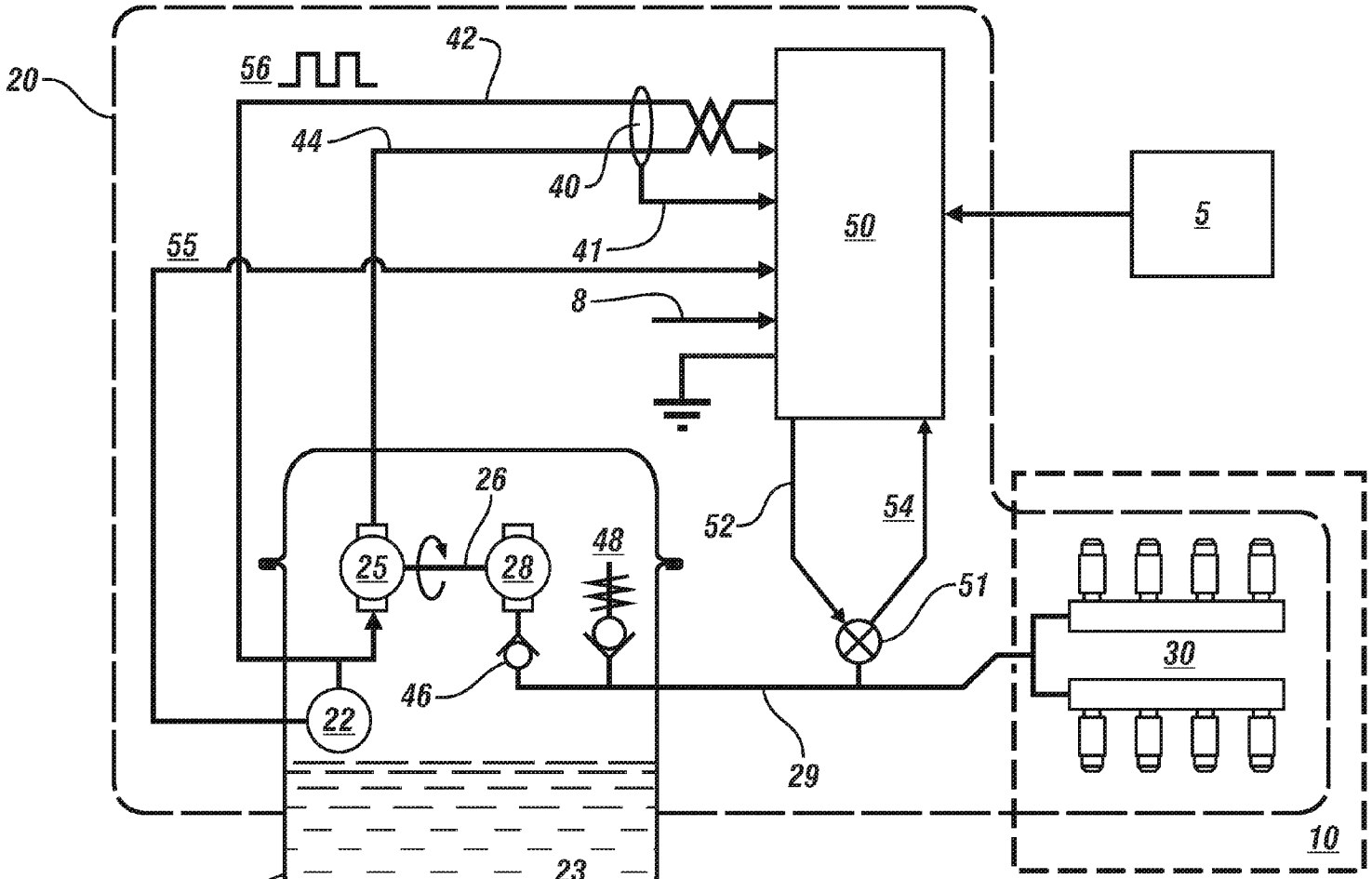
FIG. 1 schematically illustrates a returnless fuel system configured to deliver pressurized fuel to an internal combustion engine via a fuel rail, in accordance with the disclosure.

Referring now to the drawings, wherein the showings are for the purpose of illustrating certain exemplary embodiments only and not for the purpose of limiting the same, FIG. 1 schematically illustrates a returnless fuel system (RFS) 20 configured to deliver pressurized fuel to an internal combustion engine 10 via a fuel rail 30 that is in fluid communication with engine fuel injectors. The RFS 20 is preferably configured to operate at high pressure, which may be in the range of 10-20 MPa in one embodiment. The RFS 20 cooperates with a fuel tank 24 containing a supply of fuel 23 such as gasoline, ethanol, E85, or other combustible fuel. The fuel tank 24 is sealed relative to the surrounding environment and lacks a fuel return line from the fuel rail 30. The internal combustion engine 10 may be employed on a vehicle to provide torque for tractive power generation or electric power generation.

The RFS 20 includes a fuel pump 28, an electrically-powered pump motor 25 and a RFS controller 50, and employs other components, elements and systems as described herein. The fuel pump 28 and pump motor 25 are disposed within the fuel tank 24 and preferably submerged in fuel 23 contained within the fuel tank 24. The pump motor 25 electrically connects to the RFS controller 50 via control line 42, with a ground path 44 returning from the pump motor 25 to the RFS controller 50. The pump motor 25 generates and transfers mechanical power via a rotating pump shaft 26 to the fuel pump 28 in response to a pump motor control signal 56 from the RFS controller 50. The fuel pump 28 fluidly connects to the fuel rail 30 via a fuel line 29 to provide pressurized fuel to injectors of the engine 10. The fuel pump 28 is operable to pump fuel 23 to the fuel rail 30 for distribution into the internal combustion engine 10 in response to the pump motor control signal 56. The fuel pump 28 is preferably a roller vane pump or gerotor pump, and may be any suitable pump element. A fuel pressure sensor 51 is employed to monitor fuel pressure 54 in the fuel line 29. A current sensor 22 is configured to monitor electrical current 55 supplied to the pump motor 25 via control line 42. The fuel tank 24 further includes a check valve 46 and a pressure vent valve 48 disposed therein along the fuel line 29. The fuel pump 28 is electrically grounded via a ground path 44 from the pump motor 25 that includes a grounding shield 40 having a ground shield input 41 to RFS controller 50.

The RFS controller 50 signally couples to an engine control module (ECM) 5. The RFS controller 50 operatively connects to the pump motor 25 via control line 42 and signally connects to the fuel pressure sensor 51 and the current sensor 22. The RFS controller 50 generates the pump motor control signal 56 to control the pump motor 25 to operate the fuel pump 28 to achieve or maintain a desired fuel system pressure in response to commands from the ECM 5. The RFS controller 50 provides a reference voltage 52 to the pressure sensor 51 and monitors signal outputs from the pressure sensor 51 to determine the fuel pressure 54. The RFS controller 50 monitors the electrical current 55 and the fuel pressure 54 for feedback control and diagnostics.

The pump motor control signal 56 is a pulsewidth-modulated (PWM) signal in one embodiment that is communicated via control line 42 to operate the fuel pump 28. The pump motor control signal 56 provides pulsed electrical energy to the pump motor 25 in the form of a rectangular pulse wave. The pump motor control signal 56 is modulated by the RFS controller 50 resulting in a particular variation of an average value of the pulse waveform. Energy for the pump motor control signal 56 can be provided by a battery, e.g., a DC chemical-electrical energy storage system that supplies a battery input 8 to the RFS controller 50. By modulating the pump motor control signal 56 using the RFS controller 50, energy flow to the pump motor 25 is regulated to control the fuel pump 28 to achieve a desired fuel system pressure for the fuel supplied to the fuel rail 30. The RFS 20 described herein is meant to be illustrative, and other embodiments of fuel systems are within the scope of the disclosure.

The pump motor 25 is preferably a brush-type electric motor or another suitable electric motor that provides mechanical power via a rotating pump shaft 26 to the fuel pump 28. The fuel pump 28 propels fuel into the fuel line 29 to the fuel rail 30, thereby generating pressurized fuel in the fuel line 29 and the fuel rail 30, with the fuel pressure 54 monitored by the RFS controller 50 using the pressure sensor 51.

The RFS controller 50 controls the fuel pump 28 to achieve and/or maintain the desired fuel system pressure by applying closed-loop correction derived from the monitored fuel pressure 54 measured by the pressure sensor 51 and the monitored pump current 55 measured by the current sensor 22 as feedback. Further, the pump motor control signal 56 is monitored by the RFS controller 50. Thus, monitored pump parameters preferably include the fuel pressure 54, pump current 55, and pump motor control signal 56.

Control module, module, control, controller, control unit, processor and similar terms mean any one or various combinations of one or more of Application Specific Integrated Circuit(s) (ASIC), electronic circuit(s), central processing unit(s) (preferably microprocessor(s)) and associated memory and storage (read only, programmable read only, random access, hard drive, etc.) executing one or more software or firmware programs or routines, combinational logic circuit(s), input/output circuit(s) and devices, appropriate signal conditioning and buffer circuitry, and other components to provide the described functionality. Software, firmware, programs, instructions, routines, code, algorithms and similar terms mean any controller executable instruction sets including calibrations and look-up tables. The control module has a set of control routines executed to provide the desired functions. Routines are executed, such as by a central processing unit, and are operable to monitor inputs from sensing devices and other networked control modules, and execute control and diagnostic routines to control operation of actuators. Routines may be executed at regular intervals, for example each 3.125, 6.25, 12.5, 25 and 100 milliseconds during ongoing engine and vehicle operation. Alternatively, routines may be executed in response to occurrence of an event.

Figure 2:
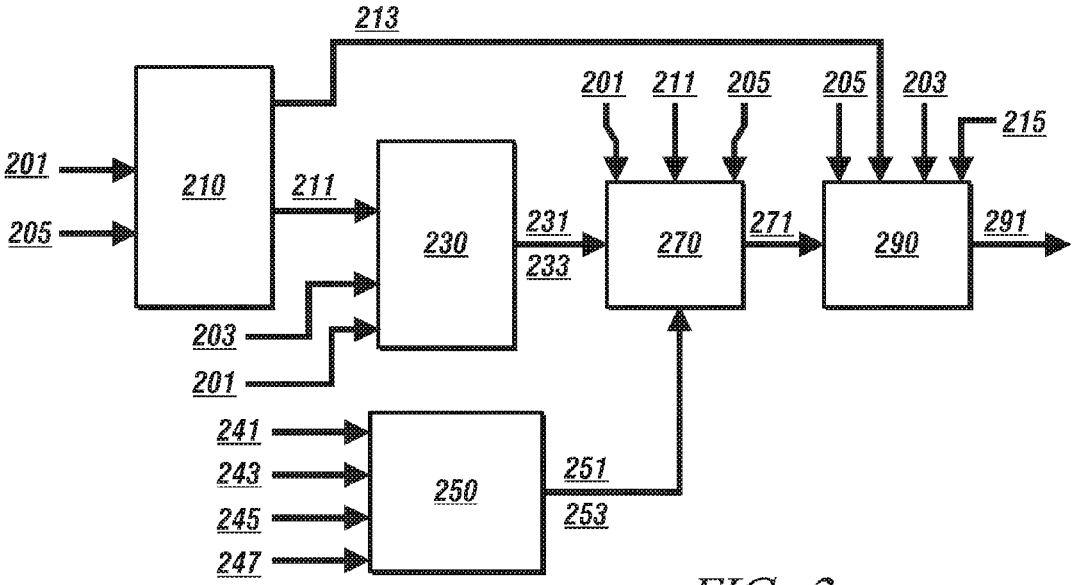
FIG. 2 illustrates a multi-step process for monitoring, detecting and diagnosing a fault in a returnless fuel system, in accordance with the disclosure.

FIG. 2 schematically illustrates a multi-step process for monitoring, detecting and diagnosing a fault in a pump motor, e.g., as applied to a returnless fuel system such as the RFS 20 described with reference to FIG. 1. The process includes estimating a pump speed $\omega_m$ 211 and estimating a nominal pump motor current $I_{nom}$ 213 (210) in relation to monitored pump parameters of a pulsewidth-modulated voltage $V_m$ 201 and fuel pressure in the returnless fuel system $P_s$ 205 (210). Motor parameters of interest are estimated, including an estimated motor armature resistance 231 and an estimated back-emf constant 233 (230). Nominal states for the motor parameters of interest are temperature-adjusted, including a temperature-adjusted armature resistance 251 and a temperature-adjusted back-emf constant 253, preferably coincident with the estimation of the motor parameters (250). Residuals 271 are determined based upon the estimated armature resistance 231, the estimated back-emf constant 233, the temperature-adjusted armature resistance 251 and the temperature-adjusted back-emf constant 253 (270). The residuals 271 are employed to monitor operation of the pump motor, including generating output signal 291 indicating presence of a pump motor fault and identifying a fault location associated with the pump motor to facilitate a root cause diagnosis of a fault (290).

The monitored parameters include pulsewidth-modulated pump motor voltage 201, fuel pressure 205 and pump motor current 203, which include monitored pump parameters of pump motor control signal 56, fuel pressure 54, and pump current 55 for the embodiment of the RFS 20 described herein. The process includes estimating the pump speed $\omega_m$ 211 and estimating a nominal pump motor current $I_{nom}$ 213 in relation to the monitored pump parameters of the pulsewidth-modulated pump motor voltage $V_m$ 201 and fuel pressure $P_s$ 205 employing the following equations (210):

$$I_{nom}=a_i(V_m)P_s+b_i(V_m) \quad [1]$$

$$\omega_m=a_\omega(V_m)P_s+b_\omega(V_m) \quad [2]$$

wherein $a_i$, $b_i$, $a_\omega$ and $b_\omega$ are application-specific scalar values.

The estimated pump speed 211 and the nominal pump motor current 213 are used in conjunction with the monitored pump motor current 203 to estimate motor parameters of interest including an estimated armature resistance 231 and an estimated back-emf constant 233. The armature resistance $R_a$ and the back-emf constant $K_e$ are employed to monitor and detect faults in the pump motor 25.

A two-stage estimation model is employed to estimate the motor parameters of interest, i.e., the estimated armature resistance 231 and the estimated back-emf constant 233 (230). During a first stage it is assumed that a back-emf constant $K_e$ is known, i.e., the back-emf constant $K_e$ has a nominal value. The armature resistance is estimated using a least-square estimation with a forgetting factor. The first stage includes defining a regression model as follows.

$$y_1(t)=\phi_1(t)*\theta_1$$

$$y_1(t)=V_m(t)-K_e*\omega_m,\phi_1(t)=I, \text{ and } \theta_1\pm R_a \quad [3]$$

wherein $K_e$ is the nominal back-emf constant and $R_a$ is the armature resistance, which is estimated as $\hat{R}_a$ employing EQ. 5, below.

During the second stage, the estimated armature resistance determined from the first stage is used and the following regression model is defined.

$$y_2(t)=\phi_2(t)*\theta_2$$

$$y_2(t)=V_m(t)-I*\hat{R}_a(t),\phi_2(t)=\omega_m,\theta_2=K_e \quad [4]$$

wherein $\hat{R}_a$ is the estimated armature resistance determined from the first stage, as described with reference to EQ. 5.

The two-stage estimation model including the least-square estimation with the forgetting factor is executed in accordance with i=1, 2, wherein i is the stage number, i.e., one of the first stage and the second stage. This is depicted in EQ. 5 as follows:

$$\hat{\theta}_i(t)=\hat{\theta}_i(t-1)+\frac{P_i(t-2)\varphi_i(t-1)}{\lambda_i(t-1)+\varphi_i^2(t-1)P_i(t-2)}\varepsilon_i(t) \quad [5]$$

$$P_i(t-1)=\frac{1}{\lambda_i(t-1)}\left[P_i(t-2)-\frac{P_i(t-2)^2\varphi_i(t-1)^2}{\lambda_i(t-1)+\varphi_i^2(t-1)P_i(t-2)}\right]$$

-continued $$\lambda_i(t) = 1 - \lambda_0 \frac{\varepsilon_i^2(t)}{1 + \varphi_i^2(t-1)P_i(t-2)}$$

$$\epsilon_1 = y_1(t) - I\hat{R}_a(t)$$

wherein $$\epsilon_2 = y_2(t) - \omega_m \hat{K}_e(t).$$

A first error term $\epsilon_1$ is associated with an error in the armature resistance and a second error term $\epsilon_2$ is associated with an error in the back-emf constant. The term $\lambda_i$ is a data-dependent weighting factor, and Pi is interpreted as a covariance of the selected parameter having a magnitude that provides a measure of the uncertainty of the parameter values. In the case of a change in motor resistance or back-emf constant from original values $\epsilon_i$ increases. This temporarily reduces $\lambda_i$ but increases $P_i$ quickly, thus permitting a rapid adaptation to the changes in the motor parameters.

The two-stage estimation model shown in EQ. 5 is translated to an algorithm that is periodically executed to determine $\hat{\theta}_i(t)$, with $\hat{\theta}_1(t)=\hat{R}_a(t)$ and $\hat{\theta}_2(t)=\hat{K}_e(t)$. The two-stage estimation model is employed for motor parameter estimation having varying parameter states due to occurrence of a fault or degradation. The use of the forgetting factors allows continuous tracking of time-varying parameters. Execution of the two-stage estimation model using least-square estimation with forgetting factors as described herein results in motor parameters of interest including the estimated armature resistance 231, i.e., $\hat{R}_a=\hat{\theta}_1$ and the estimated back-emf constant 233, i.e., $\hat{K}_e=\hat{\theta}_2$.

Nominal states for the motor parameters are temperature-adjusted, preferably coincident with the estimation of the motor parameters (250). Inputs include vehicle speed Vss 241 and pump motor temperature T 243. The nominal states include nominal armature resistance $R_0$ 245 and nominal back-emf constant $K_{e0}$ 247. The temperature-dependence of the monitored parameters may be expressed in the following relationships.

$$R_{a_nom}(T)=R_0(1+\rho(T-T_0)) \quad [6]$$

$$K_{e_nom}(T)=K_{e0}(1-\beta(T-T_0)) \quad [7]$$

The nominal states of the pump motor are determined for a known functional pump motor at nominal pump motor temperature $T_0$. The terms $R_{a_nom}(T)$ and $K_{e_nom}(T)$ are temperature-adjusted nominal states for the armature resistance and back-emf constant, respectively, which are calculated for the known functional pump motor operating at the pump motor temperature T 243. The change in resistance in relation to temperature is $\rho=0.00393/^\circ$ C. for copper magnet wire, which is employed in one embodiment of the pump motor. The change in back-emf constant in relation to temperature is $\beta=0.002/^\circ$ C. for ferrite material, which is employed in one embodiment of the pump motor.

The nominal states for the motor parameters of armature resistance and back-emf constant are adjusted for changes in pump motor temperature T that varies from the nominal temperature $T_0$. However, the pump motor temperature T is not directly monitored. Instead, a temperature difference is compensated for using forms of EQS. 6 and 7 and includes adjusting nominal states for the motor parameters of the armature resistance and the back-emf constant to account for pump motor temperature differences between an initial pump motor temperature, the nominal pump motor temperature, and an operating pump motor temperature, which is described with reference to FIG. 3. The fuel pump and pump motor are immersed in fuel in the fuel tank, which may serve to cool the pump motor. Hence any variation of the pump motor temperature from its initial conditions at the beginning of operation is assumed to be limited to a 3-5° C. change. However, at the beginning of the fuel pump operation, the fuel temperature is not necessarily equal to the nominal temperature $T_0$, i.e., the temperature at which the nominal values of the pump motor parameters were determined.

A maximum variation of the nominal motor parameters may be determined due to temperature variation based on the initial pump motor temperature. The maximum variations in the motor parameters are employed to determine thresholds at which a fault may be indicated, thus avoiding false fault detection, which is described at a later point.

Figure 3:
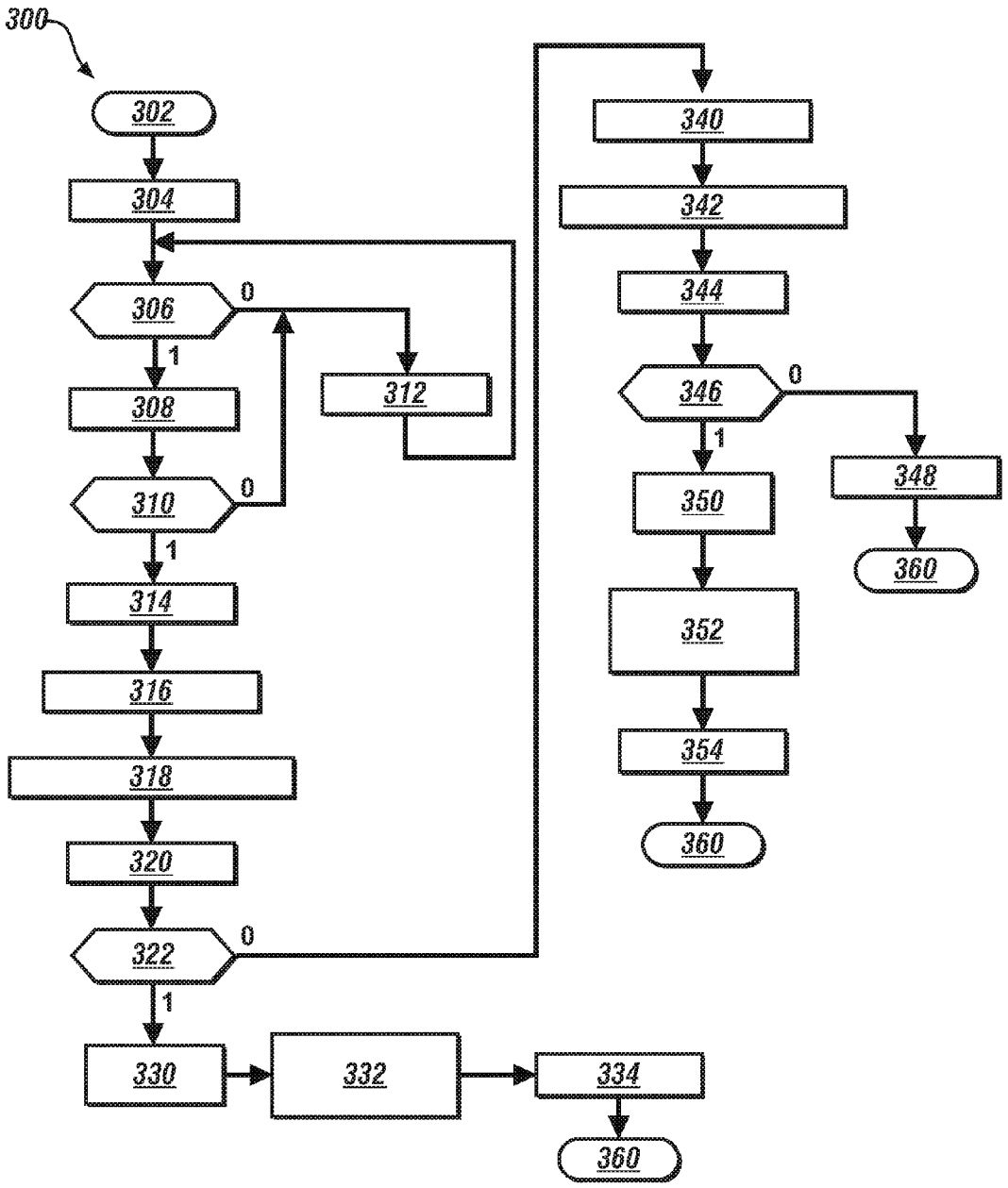
FIG. 3 illustrates an exemplary process flowchart for adjusting the nominal states for the motor parameters of resistance and back-emf constant to account for pump motor temperature differences, in accordance with the disclosure.

FIG. 3 schematically shows an exemplary process 300 flowchart for adjusting the nominal states for the motor parameters of the armature resistance and the back-emf constant to account for pump motor temperature differences between an initial pump motor temperature, the nominal pump motor temperature, and an operating pump motor temperature. As described herein, the nominal states for the motor parameters of motor armature resistance and back-emf constant are adjusted to account for differences between ambient temperature and the pump motor temperature. Table 1 is provided as a key to FIG. 3 wherein the numerically labeled blocks and the corresponding functions for the process 300 are set forth as follows.

TABLE 1

| BLOCK | BLOCK CONTENTS |
|---|---|
| 302 | Set $T_1 = T_{amb}$, Set Timer = 1 |
| 304 | $R_{init}(T_1) = R_{a_nom}(T_0)(1 + \rho(T_1 - T_0))$<br>$K_{init}(T_1) = K_{e_nom}(T_0)(1 - \beta(T_1 - T_0))$ |
| 306 | Is Vss > Vth? |
| 308 | Increment Timer |
| 310 | Is Timer > $Time_{thr}$? |
| 312 | $R_{adj} = R_{a_nom}(T_0)(1 + \rho(T_1 - T_0))$<br>$K_{adj} = K_{e_nom}(T_0)(1 - \beta(T_1 - T_0))$ |
| 314 | Set $T_2 = T_{amb}$ |
| 316 | $R_2(T_2) = R_{init}(T_1)(1 + \rho(T_2 - T_1))$ |
| 318 | $A_1 = \lvert\hat{R}_a - R_2\rvert, A_2 = \lvert\hat{R}_a - R_{a_nom}\rvert, A_3$ |
| 320 | Select $\min(A_1, A_2, A_3)$ |
| 322 | Is $\min(A_1, A_2, A_3) < A_{thr}$? |
| 330 | $R_{adj} = \begin{cases} \hat{R}_a \text{ if } A_1 \\ R_{a_nom} \text{ if } A_2 \\ R_2 \text{ if } A_3 \end{cases}$ |
| 332 | $\Delta T_{corr} = \frac{R_{adj} - R_{a_nom}}{\rho R_{a_nom}}$ |
| 334 | $K_{adj} = K_{e_nom}(T_0)(1 - \beta\Delta T_{corr})$ |
| 340 | $K_{adj} = K_2(T_2) = K_{init}(T_1)(1 - \beta(T_2 - T_1))$ |
| 342 | $B_1 = \lvert\hat{K}_e - K_2\rvert, B_2 = \lvert\hat{K}_e - K_{e_nom}\rvert, B_3$ |
| 344 | Select $\min(B_1, B_2, B_3)$ |
| 346 | Is $\min(B_1, B_2, B_3) < B_{thr}$? |
| 348 | $R_{adj} = R_{a_nom}(T_0)$<br>$K_{adj} = K_{a_nom}(T_0)$ |
| 350 | $K_{adj} = \begin{cases} \hat{K}_e \text{ if } B_1 \\ K_{e_nom} \text{ if } B_2 \\ K_2 \text{ if } B_3 \end{cases}$ |
| 352 | $\Delta T_{corr} = \frac{K_{adj} - K_{e_nom}}{\rho K_{e_nom}}$ |

TABLE 1-continued

| BLOCK | BLOCK CONTENTS |
|---|---|
| 354 | $R_{adj} = R_{a_nom}(T_0)(1 + \rho\Delta T_{corr})$ |
| 360 | End |

A timer for monitoring operating time is initialized (set Timer=1), and temperature $T_1$ is set equal to the ambient temperature $T_{amb}$ (302). The operating time may provide an indication of engine operating time, vehicle operating time, or another suitable operating time. The selected operating time is dependent upon details of the powertrain system configuration and an overall vehicle propulsion system taking into account whether the powertrain system employs multiple propulsion systems, e.g., a hybrid propulsion system in which engine operation may be intermittent during vehicle operation.

Initial states for the armature resistance $R_{init}(T)$ and back-emf constant $T_{init}(T)$ are determined in relation to temperature $T_1$ using the following equations.

$$R_{init}(T_1)=R_{a_nom}(T_0)(1+\rho(T_1-T_0))$$

$$K_{init}(T_1)=K_{e_nom}(T_0)(1-\beta(T_1-T_0))$$

The above terms are defined as described with reference to EQS. 6 and 7 (304).

Operation of the engine system is monitored, including monitoring vehicle speed (Vss) to determine that it is greater than a threshold speed (Vth) (306), incrementing the Timer (308), and determining whether the Timer is greater than a threshold time $Time_{thr}$ (310). The purpose of the monitoring operation of the engine system is to permit the system to operate for a sufficient period of time to achieve homeostasis with regard to temperature in the RFS 20. During this period, the nominal states for the armature resistance $R_{a_nom}(T)$ and back-emf constant $K_{e_nom}(T)$ are adjusted for ambient temperature using the following equations.

$$R_{adj}=R_{a_nom}(T_0)(1+\rho(T_1-T_0))$$

$$K_{adj}=K_{e_nom}(T_0)(1-\beta(T_1-T_0))$$

$R_{adj}$ is the armature resistance adjusted for ambient temperature and $K_{adj}$ is the back-emf constant adjusted for ambient temperature. The other terms are defined as described with reference to EQS. 6 and 7 (312).

When the Timer is greater than the threshold time $Time_{thr}$ (310)(1), temperature state $T_2$ is set equal to the ambient temperature $T_{amb}$ (314), which may have changed due to operation of the vehicle including a change in location, such as exiting a garage in which the vehicle is parked.

A second state for the armature resistance $R_2(T_2)$ is calculated in accordance with EQ. 8 (316).

$$R_2(T_2)=R_{init}(T_1)(1+\rho(T_2-T_1)) \quad [8]$$

This calculation of armature resistance $R_2(T_2)$ is the adjusted armature resistance based upon the initial state for the armature resistance $R_{init}(T_1)$ and any difference in temperature between the initial ambient temperature $T_1$ and the present ambient temperature $T_2$.

Terms $A_1$, $A_2$, and $A_3$ are determined in accordance with the following relationships (318):

$$A_1=|\hat{R}_a-R_2|, A_2=|\hat{R}_a-R_{a_nom}|, A_3=|R_2-R_{a_nom}|$$

wherein $\hat{R}_a$ is the estimated armature resistance, $R_{a_nom}$ is the temperature-adjusted nominal armature resistance, and $R_2$ is $R_2(T_2)$ i.e., the armature resistance determined at temperature $T_2$ as described with reference to EQ. 8.

A minimum state of the terms $A_1$, $A_2$, and $A_3$ is selected (320), and compared to a threshold value $A_{thr}$ (322). When the minimum state of the terms $A_1$, $A_2$, and $A_3$ is less than a threshold value $A_{thr}$ (1), the temperature-adjusted armature resistance $R_{adj}$ is selected in accordance with the following scheme based upon the selected minimum state of the terms $A_1$, $A_2$, and $A_3$ (330).

$$R_{adj} = \begin{cases} \hat{R}_a \text{ if } A_1 \\ R_{a_nom} \text{ if } A_2 \\ R_2 \text{ if } A_3 \end{cases}$$

A temperature correction term $\Delta T_{corr}$ is calculated in accordance with EQ. 9 (332).

$$\Delta T_{corr} = \frac{R_{adj} - R_{a_nom}}{\rho R_{a_nom}} \quad [9]$$

The temperature correction term $\Delta T_{corr}$ is employed to calculate a temperature-adjusted back-emf constant $K_{adj}$ in accordance with EQ. 10 (334).

$$K_{adj}=K_{e_nom}(T_0)(1\beta\Delta T_{corr}) \quad [10]$$

Thus the temperature-adjusted armature resistance $R_{adj}$ 251 and the temperature-adjusted back-emf constant $K_{adj}$ 253 are determined, and operation of the control scheme 300 ends (360).

Alternatively, when the minimum state of the terms $A_1$, $A_2$, and $A_3$ is greater than the threshold value $A_{thr}$ (O), the temperature-adjusted back-emf constant $K_{adj}$ at temperature $T_2$ is determined in accordance with EQ. 11 (340).

$$K_{adj}=K_2(T_2)=K_{init}(T_1)(1-\beta(T_2-T_1)) \quad [11]$$

Terms $B_1$, $B_2$, and $B_3$ are determined in accordance with the following relationships (342).

$$B_1=|\hat{K}_e-K_2|, B_2=|\hat{K}_e-K_{e_nem}|, B_3=|K_2-K_{e_nom}|$$

$\hat{K}_e$ is the estimated back-emf constant, $K_{e_nom}$ is the temperature-adjusted nominal state for the back-emf constant, and $K_2$ is $K_2(T_2)$, i.e., the back-emf constant at temperature $T_2$ as described with reference to EQ. 11.

A minimum state of the terms $B_1$, $B_2$, and $B_3$ is selected (344), and compared to a threshold value $B_{thr}$ (346). When the minimum state of the terms $B_1$, $B_2$, and $B_3$ is less than the threshold value $B_{thr}$ (1), the temperature-adjusted back-emf constant $K_{adj}$ is selected in accordance with the following scheme based upon the selected minimum state of the terms $B_1$, $B_2$, and $B_3$ (350).

$$K_{adj} = \begin{cases} \hat{K}_e \text{ if } B_1 \\ K_{e_nom} \text{ if } B_2 \\ K_2 \text{ if } B_3 \end{cases}$$

A temperature correction term $\Delta T_{corr}$ is calculated in accordance with EQ 12 (352).

$$\Delta T_{corr} = \frac{K_{adj} - K_{e_nom}}{\rho K_{e_nom}} \quad [12]$$

The temperature correction term $\Delta T_{corr}$ is employed to calculate a temperature-adjusted armature resistance $R_{adj}$ in accordance with EQ 13 (354).

$$R_{adj}=R_{a_nom}(T_0)(1+\beta\Delta T_{corr}) \quad [13]$$

Thus the temperature-adjusted armature resistance $R_{adj}$ 251 and the temperature-adjusted back-emf constant $K_{adj}$ 253 are determined, and operation of the control scheme 300 ends (360).

Alternatively, when the minimum state of the terms $B_1$, $B_2$, and $B_3$ is less than the threshold value $B_{thr}$ (O), the temperature-adjusted back-emf constant $K_{adj}$ and the temperature-adjusted armature resistance $R_{adj}$ are determined in accordance with the following relationships (348).

$$R_{adj}=R_{a_nom}(T_0)$$

$$K_{adj}=K_{e_nom}(T_0)$$

Thus the temperature-adjusted armature resistance $R_{adj}$ 251 and the temperature-adjusted back-emf constant $K_{adj}$ 253 are determined, and operation of the control scheme 300 ends (360).

Referring again to FIG. 2, the residuals 271 are calculated (270) in accordance with EQ. 14 using the pulsewidth-modulated pump motor voltage $V_m$ 201, the estimated pump speed $\omega_m$ 211, the pump motor current I 203, the temperature-adjusted armature resistance $R_{adj}$ 251, the temperature-adjusted back-emf constant $K_{adj}$ 253, the estimated armature resistance $\hat{R}_a$ 231 and the estimated back-emf constant $\hat{K}_e$ 233.

$$r_1=|V_m-I\hat{R}_a-K_{adj}\omega_m|$$

$$r_2=|V_m-IR_{adj}-\hat{K}_e\omega_m|$$

$$r_3=|V_m-I\hat{R}_a-\hat{K}_e\omega_m|$$

$$r_4=|V_m-IR_{adj}-K_{adj}\omega_m| \quad [14]$$

The residuals 271, i.e., $r_1$, $r_2$, $r_3$, and $r_4$ are calculated to account for any variations occurring between the temperature-adjusted armature resistance $R_{adj}$, the temperature-adjusted back-emf constant $K_{adj}$, the estimated armature resistance $\hat{R}_a$ and the estimated back-emf constant $\hat{K}_e$ that may indicate a fault in either the armature windings or magnetic elements of the pump motor 25.

The residuals 271 are employed to monitor operation of the pump motor, including generating the output signal 291 indicating presence of a fault and identifying a location associated with the pump motor to facilitate root cause diagnosis (290). The residuals 271 are preferably evaluated by comparing them to corresponding residual thresholds. The values of each of the residuals 271 will be zero under ideal conditions when the pump motor is functional. Other pump parameters involved in indicating a fault and identifying a fault location include the nominal pump motor current 213 and monitored pump motor current 203, fuel pressure 205, and a commanded fuel pressure 215 in the returnless fuel system.

Figure 4:
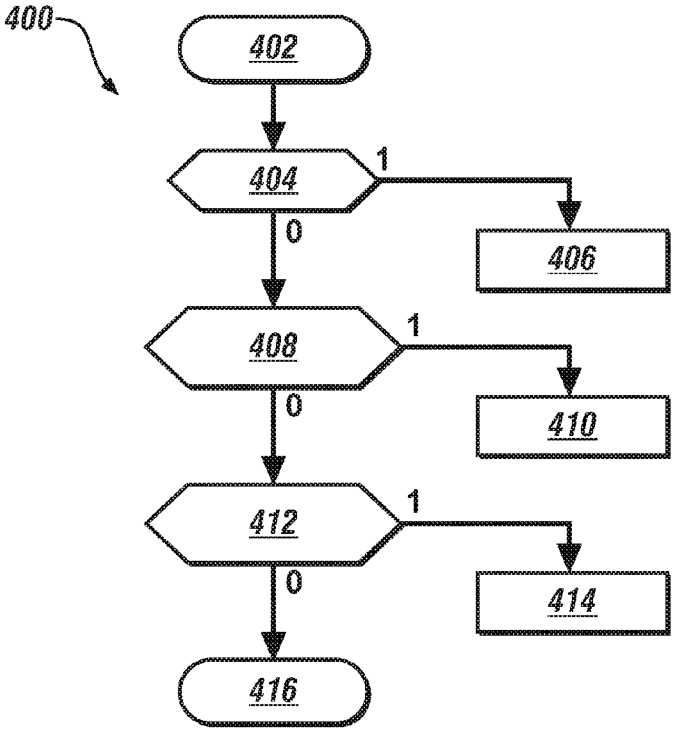
FIG. 4 illustrates an exemplary process flowchart for identifying a fault location using residuals, in accordance with the disclosure.

FIG. 4 illustrates an exemplary process 400 flowchart that employs the residuals 271, i.e., $r_1$, $r_2$, $r_3$, and $r_4$ to monitor operation of the pump motor, including indicating and identifying a fault location associated with the pump motor. Table 2 is provided as a key to FIG. 4 wherein the numerically labeled blocks and the corresponding functions are set forth as follows.

TABLE 2

| BLOCK | BLOCK CONTENTS |
|---|---|
| 402 | Determine residuals $r_1$, $r_2$, $r_3$, and $r_4$, residual thresholds $r_{th1}$, $r_{th2}$, $r_{th3}$, and $r_{th4}$, ΔI, P |
| 404 | Is $r_1 < rth_1$; $r_2 > rth_2$; $r_3 < rth_3$; $r_4 > rth_4$? |
| 406 | Indicate fault associated with armature resistance |
| 408 | Is $r_1 \geq rth_1$; $r_2 \leq rth_2$; $r_3 < rth_3$; $r_4 > rth_4$? and $\Delta I > I_{th}$? |
| 410 | Indicate fault associated with back-emf constant |
| 412 | Is $r_1 > rth_1$; $r_2 > rth_2$; $r_3 < rth_3$; $r_4 > rth_4$? and $\Delta I > I_{th}$ and $P < P_{req}$? |
| 414 | Indicate fault associated with back-emf constant and with armature resistance |
| 416 | No fault detected |

The residuals $r_1$, $r_2$, $r_3$, and $r_4$ are determined as described herein using EQ. 14. A change in pump motor current ΔI from its nominal value $I_{nom}$ is also determined. The residual thresholds $r_{th1}$, $r_{th2}$, $r_{th3}$, and $r_{th4}$ are determined in a manner that accounts for system variations. Such system variations include those resulting from differences between nominal temperatures, initial ambient temperatures, and system temperature during operation to avoid falsely detecting system faults. The residuals $r_1$, $r_2$, $r_3$, and $r_4$ are compared to corresponding residual thresholds $r_{th1}$, $r_{th2}$, $r_{th3}$, and $r_{th4}$ in accordance with the following relationship (404).

$$r_1<rth_1;r_2>rth_2;r_3<rth_3;r_4>rth_4$$

When all of the comparisons are met (1), a fault in the pump motor associated with pump motor resistance is indicated (406). When all of the comparisons are not met (O), the residuals $r_1$, $r_2$, $r_3$, and $r_4$ are compared to corresponding residual thresholds $r_{th1}$, $r_{th2}$, $r_{th3}$, and $r_{th4}$ and the change in pump motor current ΔI is compared to a current threshold $I_{th}$ in accordance with the following relationships (408).

$$r_1\geq rth_1;r_2\leq rth_2;r_3<rth_3;r_4>rth_4,\Delta I>I_{th}$$

When all of the comparisons are met (1), including the change in pump motor current exceeding the threshold current, a fault in the pump motor associated with back-emf constant is indicated (410). When all of the comparisons are not met (0), the residuals $r_1$, $r_2$, $r_3$, and $r_4$ are compared to corresponding residual thresholds $r_{th1}$, $r_{th2}$, $r_{th3}$, and $r_{th4}$, the change in pump motor current ΔI is compared to a current threshold $I_{th}$, and monitored fuel pressure P 205 is compared to the commanded fuel pressure $P_{ref}$ 215 in accordance with the following relationships (412).

$$r_1>rth_1;r_2>rth_2;r_3<rth_3;r_4>rth_4;\Delta I>I_{th};P<P_{req}$$

When all of the comparisons are met (1), including the change in pump motor current exceeding the threshold current and the fuel pressure being less than the commanded fuel pressure, a fault in the pump motor associated with back-emf constant and with armature resistance is indicated (414). When all of the comparisons are not met (0), it is an indication that there are no faults associated with operation of the pump motor related to the back-emf constant and with the armature resistance (416).

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. Method for monitoring an electric motor configured to transfer mechanical power to a fuel pump, comprising:

estimating a pump speed and a nominal pump motor current in relation to a pump motor control signal and a fuel pressure;

estimating an armature resistance and a back-emf constant for the electric motor corresponding to the estimated pump speed, a monitored pump motor current, and the pump motor control signal;

adjusting a nominal armature resistance and a nominal back-emf constant for the electric motor in relation to a pump motor temperature;

determining a plurality of residuals based upon the adjusted nominal armature resistance, the adjusted nominal back-emf constant, the estimated armature resistance and the estimated back-emf constant;

comparing the residuals with corresponding thresholds; and detecting a fault in the electric motor based upon the comparisons of the residuals with the corresponding thresholds.

2. The method of claim 1, wherein estimating the armature resistance and the back-emf constant comprises executing a two-stage estimation model.

3. The method of claim 2, wherein the estimated pump speed is determined according to the following relationship:

$$\omega_m = a_\omega(V_m)P_s + b_\omega(V_m)$$

wherein $\omega_m$ is the pump speed, $V_m$ is the pump motor control signal, $P_s$ is the fuel pressure, and $a_\omega$ and $b_\omega$ are application-specific scalar values.

4. The method of claim 2, wherein executing the two-stage estimation model comprises executing a first stage, comprising:

assuming a nominal value for the back-emf constant; and estimating the armature resistance employing a regression model for the armature resistance comprising a least-square estimation with a forgetting factor.

5. The method of claim 4, wherein the regression model comprises the following relationship:

$$y_1(t) = \phi_1(t) * \theta_1$$

$$y_1(t) = V_m(t) - K_e * \omega_m,\ \phi_1(t) = I, \text{ and } \theta_1 = R_a$$

wherein $K_e$ is the nominal value of the back-emf constant, $V_m(t)$ is the pump motor control signal, $\omega_m$ is the pump speed, and $R_a$ is the armature resistance.

6. The method of claim 2, wherein executing the two-stage estimation model comprises executing a second stage estimation model according to the following relationship:

$$y_2(t) = \phi_2(t) * \theta_2$$

$$y_2(t) = V_m(t) - I * \hat{R}_a(t),\ \phi_2(t) = \omega_m, \theta_2 = K_e$$

wherein $\hat{R}_a$ is an estimated armature resistance from a first stage, $V_m$ is the pump motor control signal, and I is the monitored pump motor current.

7. The method of claim 1, wherein adjusting the nominal armature resistance comprises determining an adjusted nominal armature resistance according to the following relationship:

$$R_{a_nom}(T) = R_0(1 + \rho(T - T_0))$$

wherein $R_0$ is a nominal armature resistance at nominal temperature $T_0$,

T is an ambient temperature, $R_{a_nom}(T)$ is the adjusted nominal armature resistance, and ρ is a material constant term for the armature resistance.

8. The method of claim 1, wherein adjusting the nominal back-emf constant comprises determining the nominal back-emf constant according to the following relationship:

$$K_{e_nom}(T) K_{e0}(1 - \beta(T - T_0))$$

wherein $K_{e0}$ is a nominal back-emf constant at nominal temperature $T_0$,

T is an ambient temperature, $K_{e_nom}(T)$ is the adjusted nominal back-emf constant, and β is a material constant term for the back-emf constant.

9. The method of claim 1, wherein determining the plurality of residuals comprises determining the plurality of residuals according to the following relationships:

$$r_1 = |V_m - I\hat{R}_a - K_{adj}\omega_m|$$

$$r_2 = |V_m - IR_{adj} - \hat{K}_e\omega_m|$$

$$r_3 = |V_m - I\hat{R}_a - \hat{k}_e\omega_m|$$

$$r_4 = |V_m - IR_{adj} - K_{adj}\omega_m|$$

wherein r1, r2, r3, and r4 are the residuals,

Radj is the temperature-adjusted armature resistance,

Kadj is the temperature-adjusted back-emf constant, $\hat{R}_a$ is the estimated armature resistance, $\hat{K}_e$ is the estimated back-emf constant, Vm is the pump motor control signal, I is the pump motor current, and ωm is a nominal pump motor speed.

10. The method of claim 1, wherein comparing the residuals with corresponding thresholds comprises determining the corresponding thresholds based upon the nominal pump motor current, the monitored pump motor current, the fuel pressure, and a commanded fuel pressure in the returnless fuel system.

11. Method for monitoring an electric motor configured to provide mechanical power to a fuel pump of a returnless fuel system, comprising:

estimating a pump speed and a nominal pump motor current in relation to a pump motor control signal and a fuel pressure in the returnless fuel system;

estimating an armature resistance and a back-emf constant for the electric motor corresponding to the estimated pump speed, a monitored pump motor current, and the pump motor control signal; and detecting a fault in the electric motor based upon the estimated armature resistance and the estimated back-emf constant for the electric motor.

12. The method of claim 11, wherein estimating the armature resistance and the back-emf constant comprises executing a two-stage estimation model.

13. The method of claim 12, wherein the estimated pump speed is determined according to the following relationship:

$$\omega_m = a_\omega(V_m)P_s + b_\omega(V_m)$$

wherein $\omega_m$ is the pump speed, $V_m$ is the pump motor control signal, $P_s$ is the fuel pressure, and $a_\omega$ and $b_\omega$ are application-specific scalar values.

14. The method of claim 12, wherein executing the two-stage estimation model comprises executing a first stage, comprising:

assuming a nominal value for the back-emf constant; and estimating the armature resistance employing a regression model for the armature resistance comprising a least-square estimation with a forgetting factor.

15. The method of claim 14, wherein the regression model comprises the following relationship:

$$y_1(t)=\phi_1(t)*\theta_1$$

$$y_1(t)=V_m(t)-K_e*\omega_m,\ \phi_1(t)=I,\text{ and }\theta_1=R_a$$

wherein $K_e$ is the nominal value of the back-emf constant, $V_m(t)$ is the pump motor control signal, $\omega_m$ is the pump speed, and $R_a$ is the armature resistance.

16. The method of claim 12, herein executing the two-stage estimation model comprises executing a second stage estimation model according to the following relationship:

$$y_2(t)=\phi_2(t)*\theta_2$$

$$y_2(t)=V_m(t)-I*\hat{R}_a(t),\ \phi_2(t)=\omega_m,\theta_2=K_e$$

wherein $\hat{R}_a$ is an estimated armature resistance from a first stage, $V_m$ is the pump motor control signal, and I is the monitored pump motor current.

17. The method of claim 11, wherein detecting the fault in the electric motor based upon the estimated armature resistance and the estimated back-emf constant comprises:

determining a temperature adjusted nominal armature resistance according to the following relationship:

$$R_{a_nom}(T)=R_0(1+\rho(T-T_0))$$

wherein $R_0$ is a nominal armature resistance at nominal temperature $T_0$,

T is an ambient temperature, $R_{_nom}(T)$ is the adjusted nominal armature resistance, and ρ is a material constant term for the armature resistance;

determining a temperature-adjusted nominal back-emf constant according to the following relationship:

$$K_{e_nom}(T)=K_{e0}(1-\beta(T-T_0))$$

wherein $K_{e0}$ is a nominal back-emf constant at nominal temperature $T_0$,

T is an ambient temperature, $K_{e_nom}(T)$ is the adjusted nominal back-emf constant, and β is a material constant term for the back-emf constant; and detecting presence of a fault in the electric motor based upon the estimated armature resistance, the temperature-adjusted nominal armature resistance, the estimated back-emf constant and the temperature-adjusted nominal armature resistance.

18. The method of claim 17, wherein detecting the fault in the electric motor based upon the estimated armature resistance, the temperature-adjusted nominal armature resistance, the estimated back-emf constant and the temperature-adjusted nominal armature resistance comprises:

determining a plurality of residuals based upon the estimated armature resistance, the temperature-adjusted nominal armature resistance, the estimated back-emf constant and the temperature-adjusted nominal armature resistance according to the following relationships:

$$r_1=|V_m-I\hat{R}_a-K_{adj}\omega_m|$$

$$r_2=|V_m-IR_{adj}-\hat{K}_e\omega_m|$$

$$r_3=|V_m-I\hat{R}_a-\hat{K}_e\omega_m|$$

$$r_4=|V_m-IR_{adj}-K_{adj}\omega_m|$$

wherein r1, r2, r3, and r4 are the residuals,

Radj is the temperature-adjusted armature resistance,

Kadj is the temperature-adjusted back-emf constant, $\hat{R}_a$ is the estimated armature resistance, $\hat{K}_e$ is the estimated back-emf constant, Vm is the pump motor control signal, I is the pump motor current, and ωm is a nominal pump motor speed; and comparing the residuals with corresponding thresholds determined based upon the nominal pump motor current, the monitored pump motor current, the fuel pressure, and a commanded fuel pressure in the returnless fuel system;

wherein detecting the fault in the electric motor is based upon the comparisons of the residuals with the corresponding thresholds.

* * * * *